US006610947B2

(12) United States Patent
Campana et al.

(10) Patent No.: US 6,610,947 B2
(45) Date of Patent: Aug. 26, 2003

(54) ROTARY SWITCH

(75) Inventors: Urs Campana, Zwingen (CH); Otto Gut, Dornach (CH)

(73) Assignee: Saia-Burgess Gateshead Ltd. Dukesway, Team Valley, Trading Estate, GB-Gateshead (GB)

( * ) Notice: Subject to any disclaimer, the term of this patent is extended or adjusted under 35 U.S.C. 154(b) by 0 days.

(21) Appl. No.: 09/803,697

(22) Filed: Mar. 9, 2001

(65) Prior Publication Data

US 2001/0020576 A1 Sep. 13, 2001

(30) Foreign Application Priority Data

Mar. 10, 2000 (CH) ..... 0468/00
May 8, 2000 (CH) ..... 0895/00

(51) Int. Cl.[7] ..... H01H 21/02
(52) U.S. Cl. ..... 200/336; 70/395; 70/408
(58) Field of Search ..... 200/336, 564, 200/43.08, 43.03; 70/395–397, 408

(56) References Cited

U.S. PATENT DOCUMENTS 1,936,163 A * 11/1933 Jacobi ..... 200/43.08
3,257,517 A 6/1966 Sedley
3,629,530 A * 12/1971 Fischer ..... 200/43.08
3,767,880 A * 10/1973 Austin ..... 200/336 X
4,292,995 A * 10/1981 Mazzola ..... 70/408 X
5,060,486 A 10/1991 Linstromberg
5,159,706 A 10/1992 Hodsdon
5,954,192 A * 9/1999 Iitsuka ..... 200/336
6,281,453 B1 * 8/2001 Uleski ..... 200/336 X

FOREIGN PATENT DOCUMENTS

BE 694 699 7/1967
DE 29 18 406 11/1980

* cited by examiner

*Primary Examiner*—Renee Luebke
(74) *Attorney, Agent, or Firm*—Collen IP; Robert M. McDermott

(57) ABSTRACT

The rotation of a rotary switch is limited by stop ribs in a knob that facilitates the rotation of the rotary switch. The stop ribs can be configured to limit the rotational stress that is applied to the rotary switch, or to limit the states of the switch that are realizable by a particular knob. Using keyed detachable knobs, different keys can be configured to provide different ranges of rotation of the rotary switch, thereby enabling different switching authorizations, based on the particular knob that is used.

12 Claims, 4 Drawing Sheets

ROTARY SWITCH

BACKGROUND OF THE INVENTION

1. Field of the Invention

Rotary switches are switched on and off by the rotational movement of a rotary handle. They are in the form of at least two parts and have a rotatable switching means arranged in a housing and a rotary knob having a coupling element which can be pushed into or onto the switching means. They are used, for example, as electrical switches in construction machines, electronic data processing systems and various other apparatuses. They may be in the form of simple electrical on/off switches or in the form of complicated three-way or multiway switches.

2. Description of the Prior Art

However, rotary switches are also used in other technical areas. Thus, for example, U.S. Pat. No. 5,060,486 discloses a thermostat controller for a refrigerator and freezer. This thermostat controller is intended for establishing four permanent control ranges and has a rotary knob with four rib-like stop elements and a stationary final control element which is arranged on the thermostat housing and can be brought into contact with the stop elements of the rotary knob. In order to set a specific control range, the final control element is therefore set between, in each case, two stop elements, for which purpose the rotary knob is pulled out axially, then turned to the desired position—i.e. to the position corresponding to the control range to be selected—and then pushed back onto the thermostat housing.

The present invention relates to an electrical rotary switch for switching electrical signals on and off, in particular an electrical key switch.

In the case of known key switches, the coupling element which can be pushed into or onto the electrical switching means is a key or a key bit which, during use, is inserted into a slot provided for it in the switching element. In order to protect the switching means from soiling, the key or the key bit is additionally used in a cap-like rotary handle or rotary knob which is mounted on, or pushed onto, the housing of the switch element. In these cases, the latter preferably projects so far out of the front plate of the switch panel that an effective connection between the switch element and the coupling element or the key of the rotary knob is possible.

The known key switches have no sufficient securing means to prevent overturning of the key. In extreme cases—especially with the application of excessive force—this leads to the key bit breaking off or to damage to the switching mechanism, which then generally results in a tedious and expensive replacement of the entire switch.

SUMMARY OF THE INVENTION

It is the object of the present invention to provide a rotary switch in which undesirable overturning of the key is not possible.

This object is achieved, according to the invention, by a rotary switch comprising rotatable switching means arranged in a cylindrical or conical housing and a rotary knob which is provided with a coupling element insertable into the switching means wherein the rotary switch is secured to prevent overturning of the coupling element by ribs which are arranged on the rotary knob and on the outside of the front plate or on said housing and can come into contact with one another.

The novel rotary switch has a housing having a rotatable switching means and a rotary knob having a coupling element which can be pushed into or onto the switching means. According to the invention, undesired overturning of the coupling element, preferably in the form of a key, is prevented by ribs which are arranged on the rotary knob and on the front plate carrying the rotary switch or on said housing and which are capable of coming into contact with one another. The invention is thus distinguished essentially in that, when the rotary knob is in the pushed-in or pushed-on state, it engages a stationary stop rib and thus limits the rotational movement of the key to a rotational range specified in advance.

An advantageous embodiment of the invention envisages that an annular securing disc having a stop rib projecting from the front plate is arranged on the front plate and that the rotary knob has a projecting, arc-shaped rib which, when the rotary knob is in the pushed-on state, can be made to engage the stop rib of the securing disc. In this case, the overturning prevention device according to the invention is therefore formed in such a way that it can also be readily adapted to or mounted on known and already installed rotary switches of the type mentioned at the outset.

Another advantageous embodiment of the invention envisages providing the key switch with at least two rotary knobs which in turn, owing to a different type of rib design, permit different rotational movements for the actuation of a rotary switch at least in the form of a three-way switch. This in turn makes it possible to provide the operator with different rotary buttons depending on his task, which rotary buttons in turn permit 1, 2 or more switching operations on one and the same switch element and can thus be used as so-called authorization keys.

BRIEF DESCRIPTION OF THE DRAWINGS

The subject of the invention is described in more detail with reference to embodiments shown in the drawing. In the drawing.

DESCRIPTION OF THE PREFERRED EMBODIMENTS

Figure 1:
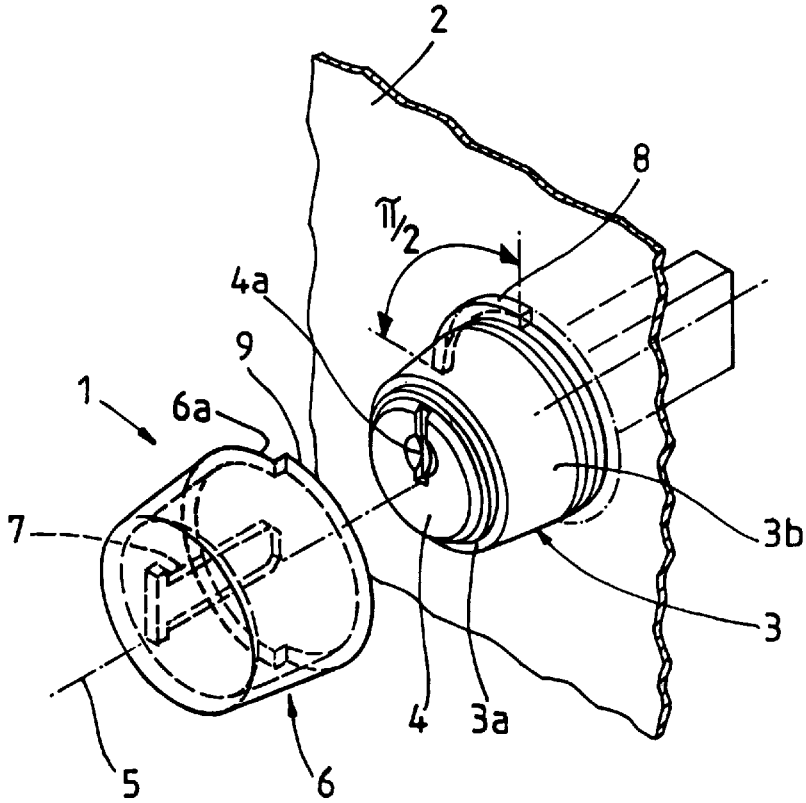
FIG. 1 shows a perspective view of a rotary switch having an overturning prevention device according to the invention.

The rotary switch shown in FIG. 1 and denoted as a whole by 1 is installed in a front plate 2 of a control element not defined in more detail. It has a switch housing 3 with a rotatable switching means 4 arranged in said switch housing. Said switching means is accessible from the front 3*a* of the housing 3 and has an actuating mechanism known per se, namely a mechanical key switching mechanism. In this case, by turning the switching means 4 about the axis 5, electrical switching pulses are thus transmitted, by connecting means shown only schematically here, to a device to be controlled.

The rotary switch 1 furthermore includes a cap-like rotary knob 6 having a key 7 fastened in the interior of the cap and fitting the slot 4*a* of the switching means 4.

The housing 3 of the switch has a substantially cylindrical or conical section 3*b* which is coaxial with the axis 5 and is dimensioned in such a way that the cylindrical switching means 4 can be pushed through the housing orifice at the front 3*a*. The housing 3 is moreover formed in such a way that it can be mounted with known means on the front plate 2 of the control element. This mounting means will therefore not be discussed in more detail below.

An arc-shaped, stationary stop rib 8 which has a length of ¶/2, measured in radian measure, is arranged on the front of the front plate 2 against the housing 3.

Figure 2:
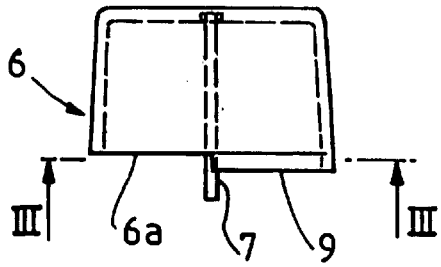
FIG. 2 shows a side view of the rotary knob of the switch shown in FIG. 1.
Figure 3:
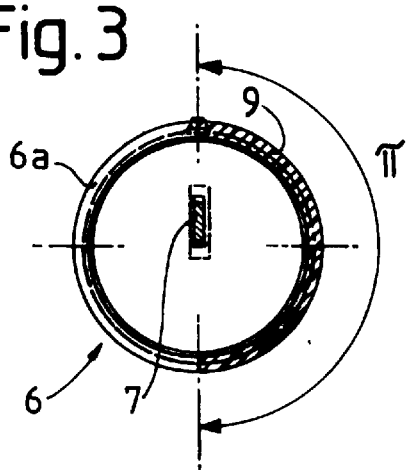
FIG. 3 shows a section along the line III of FIG. 2, FIGS. 4 to 9 each show an embodiment of a securing disc which can be installed as a washer in a rotary switch and has in each case an arc-shaped stop rib fitting the rotary knob of a rotary switch.
Figure 4:
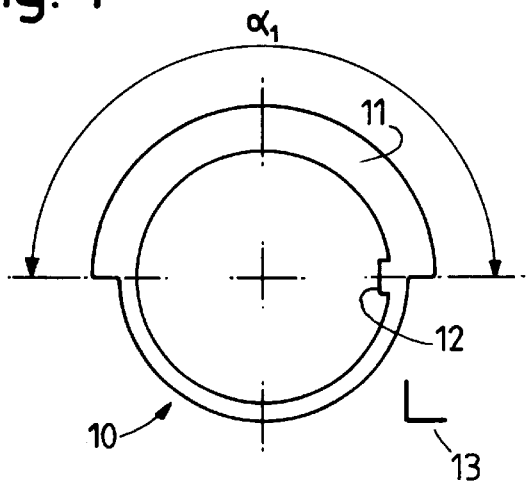
Figure 5:
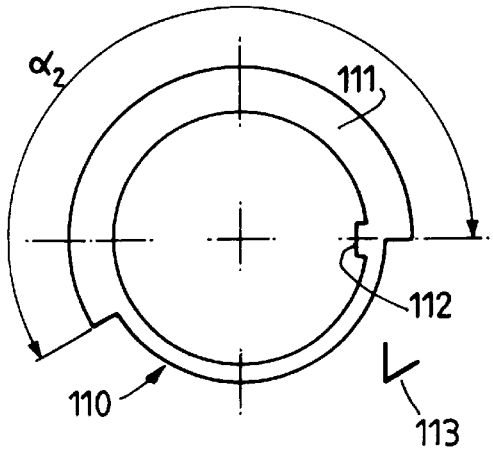
Figure 6:
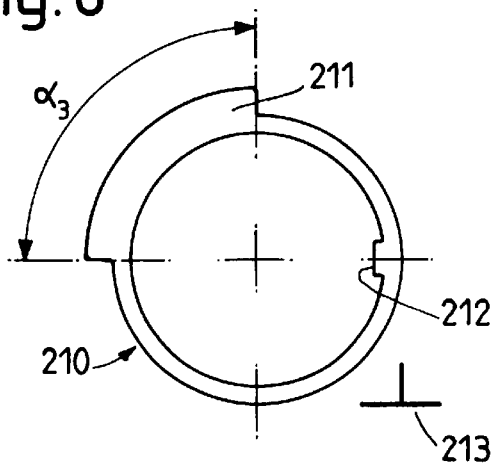
Figure 7:
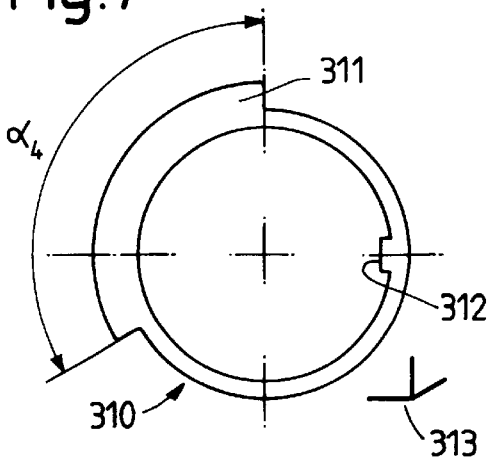
Figure 8:
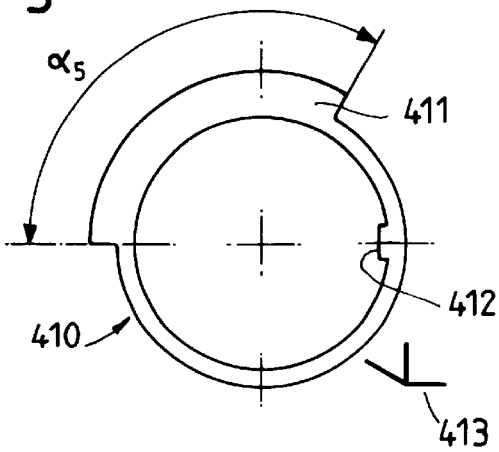
Figure 9:
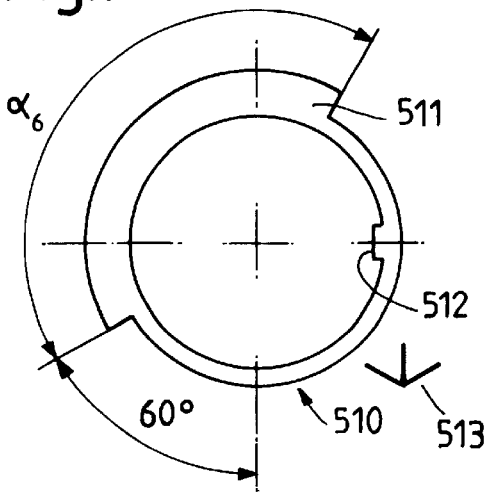

The rotary knob 6 shown in two further views in FIGS. 2 and 3 has a substantially cylindrical or conical wall section with an arc-shaped rib 9 projecting beyond the free end of the cylindrical or conical wall section and, in the mounted state, facing the front plate 2. This rib 9 has an arc length ¶ and is dimensioned, and arranged with respect to the insertion position of the key 7, in such a way that the stop rib 8 and the rib 9 strike one another when the rotary knob 6 is turned, before the key 7 is overturned. The latter has, in the embodiment shown, an angle of rotation of not more than 90°. The rotary switch 1 is thus formed in such a way that the rotary knob 6 can be turned not more than 90° clockwise from the position shown in FIG. 1 and back again. The rotary switch 1 can thus be used, for example, as an electrical on/off switch.

Of course, the stop rib 8 and the rib 9 strike one another only when they mutually engage corresponding recesses, i.e. when the stop rib 8 engages the recess 6*a* of the free end of the cylindrical or conical rotary knob wall section, which recess is bounded by the rib 9.

The stationary stop rib 8 of the overturning prevention device according to the invention can be arranged, as shown in FIG. 1, on the front of the front plate 2, for example welded, adhesively bonded or otherwise nondetachably fastened to this.

In the context of the invention, however, the stop rib 8 can also be provided on the housing 3 containing the switching means 4 or—as already mentioned above—on a securing disc which in turn is arranged on the front plate of a switch panel. The latter variant has the substantial advantage that the overturning prevention device according to the invention, in turn consisting of ribs arranged on the rotary knob and on the securing disc and capable of striking one another, can be adapted to known rotary switches or even mounted subsequently on already installed rotary switches without great expense. Thus, commercial rotary switches can readily be equipped with the overturning prevention device according to the invention, for which purpose, in a first step, the securing disc is then mounted on the front plate and the switch housing is then fastened thereto, which can be effected, for example, by a screw nut which is screwed onto a thread provided on the switch housing.

Examples of securing discs are shown in FIGS. 4 to 9. They are denoted as a whole by 10, 110, 210, 310, 410 and 510 and each have a stop rib 11, 111, 211, 311, 411 and 511, respectively, intended as a stop for the rib of the associated rotary knob. For securing the position of the securing discs 10, 110, 210, 310, 410 and 510 relative to the front plate and to the switch housing, the discs additionally each have a projection 12, 112, 212, 312, 412 and 512 which projects radially inwards and, in the inserted state, engages a recess of the housing and thus acts as an antirotation device, preventing undesired rotation of the disc.

A standard rotary knob which has an arc-shaped stop rib having the arc length ¶/2 is preferably used as a rotary knob fitting the securing discs. As shown in FIGS. 4 to 9, the suitable discs have stop ribs with different arc lengths. Thus, the arc angles in the sequence of the numbering in the Figures are as follows: 180°, 210°, 90°, 120°, 120°, 150°.

In particular, the securing discs 10 and 110 according to the switching symbols 13 and 113 are provided for two-way switches and the securing discs 211, 311, 411 and 511 according to the switching symbols 213, 313, 413 and 513 are provided for three-way switches.

Both the securing ring and the rotary knob which fits it may readily be standard embodiments which fit different key switches.

Figure 10:
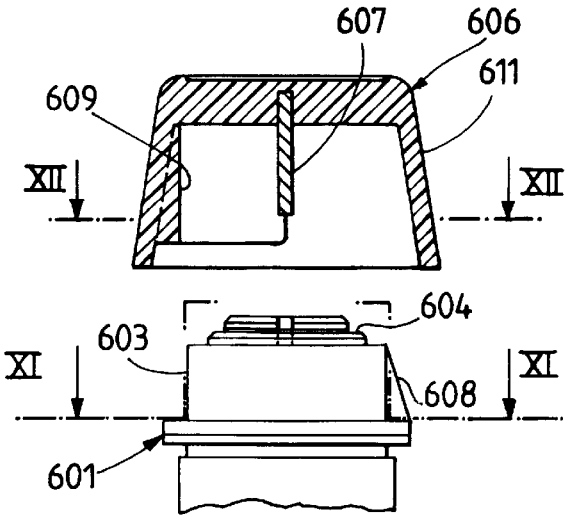
FIG. 10 shows an embodiment of a three-way switch shown partly in section and having a first authorization key.
Figure 15:
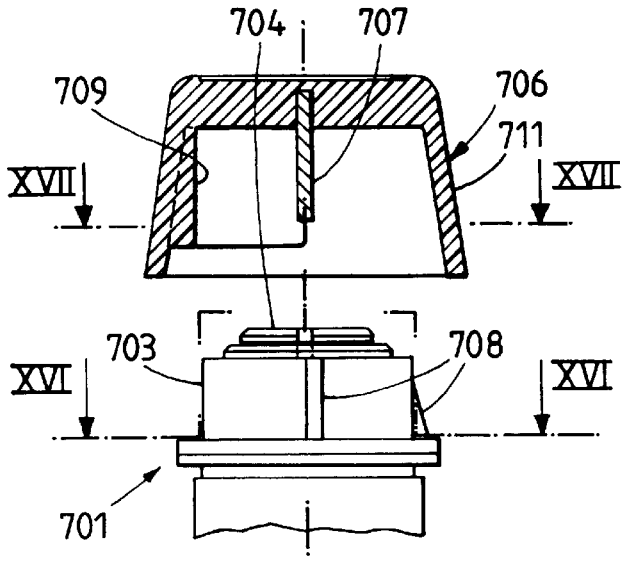
FIG. 15 shows a second embodiment of a three-way switch shown partly in section and likewise having a first authorization key.

Examples of key switches in which the stationary stop rib is provided on the housing containing the switching means are shown in FIGS. 10 and 15. The two rotary switches 601 and 701 shown in these Figures are essentially formed in exactly the same way as the switch 1 and each have a switch housing 603, 703 with a rotatable switching means 604, 704 arranged therein, and each have a cap-like rotary knob 606, 706 with a key 607, 707 fitting the slot of the switching means. In contrast to the rotary switch 1, the arc-shaped ribs 609 and 709 of the rotary knobs 606 and 706, which ribs serve for preventing overturning, are arranged on the inside of the conical wall section 611 and 711, respectively, which in these cases enables the at least one stop rib 608 or 708 arranged on the switch housing to overlap that end of the conical wall section 611, 711 which has been cut straight.

Figure 12:
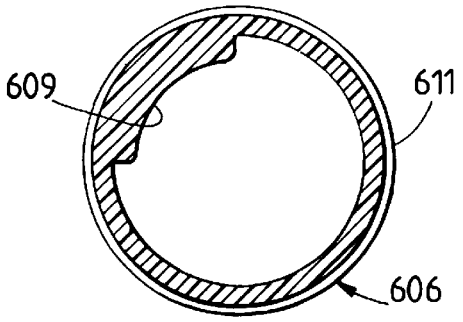
FIG. 12 shows a section along the line XII of FIG. 10.
Figure 13:
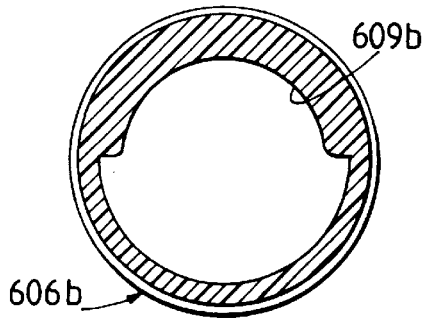
FIG. 13 shows a section through the cylindrical cap of a second authorization key intended for the switch of FIG. 10.
Figure 17:
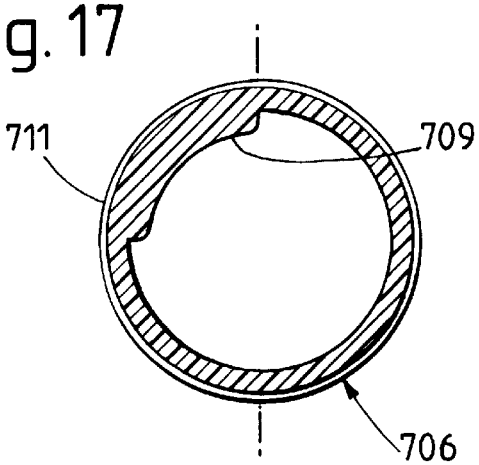
FIG. 17 shows a section along the line XVII of FIG. 15.
Figure 18:
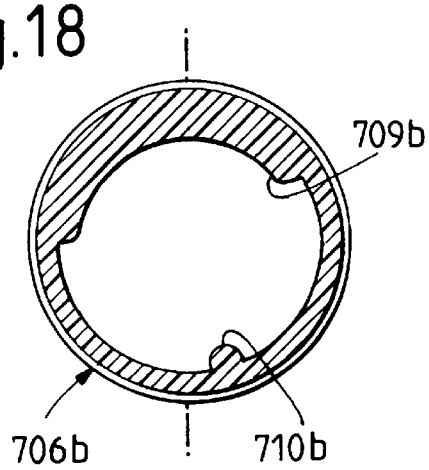
FIG. 18 shows a section through the cylindrical cap of the second authorization key fitting the switch of FIG. 15.

The key switches 601 and 701 shown in FIGS. 10 and 15 are furthermore in the form of three-way switches, to each of which two different authorization keys belong. One of these two authorization keys is formed by the rotary knob 606 or 706 described above and shown in section in FIGS. 12 and 17, respectively, and the other is formed by the rotary knob 606*b* or 706*b* shown in section in FIGS. 13 and 18, respectively.

Figure 11:
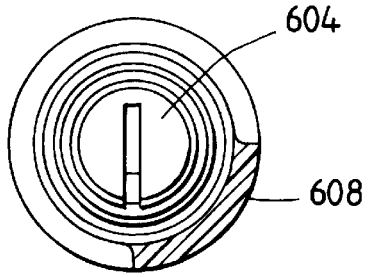
FIG. 11 shows a section along the line XI of FIG. 10.
Figure 14:
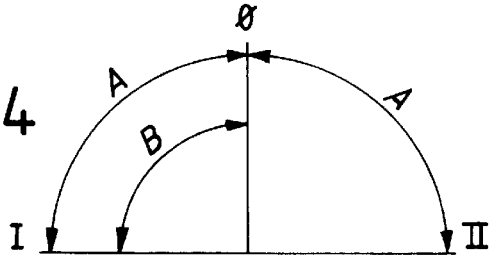
FIG. 14 shows the switching diagram for the three-way switch shown in FIGS. 10 to 13.

The switch 601 is a three-way switch having the three fixed switching positions I, Ø, II. As is evident from FIGS. 11, 12 and 13, the stop rib 608 of the housing 603 has a length of ¶/2, measured in radian measure, the rotary knob 606 has a rib 609 which matches this and has the length of likewise ¶/2 and the rotary knob 606*b* has a rib having the length ¶. In the drawing, it is now clear that the two rotary knobs 606 and 606*b* permit various switching authorizations when pushed on, owing to their different rib structures. Thus, it is evident from the diagram of FIG. 14 that two 90° rotary switching operations (A) are possible with the rotary knob 606, whereas the rotary knob 606*b* permits only one 90° switching operation (B), i.e. the switching operation I-Ø, owing to the longer rib 609*b*.

Figure 16:
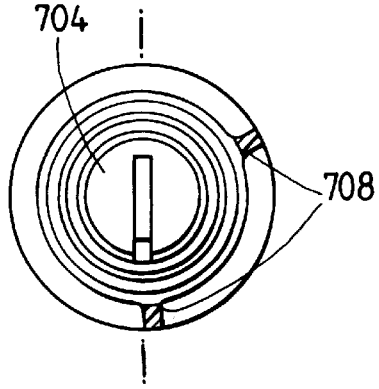
FIG. 16 shows a section along the line XVI of FIG. 15.

Switch 701 is likewise a three-way switch, but it has two fixed switching positions I and Ø with an intermediate angle of 90° and a pulse switching position II with an angle of rotation of 60°. As is evident from FIGS. 16, 17 and 18, in this case the housing 703 has two narrow, stop ribs 608.

Figure 19:
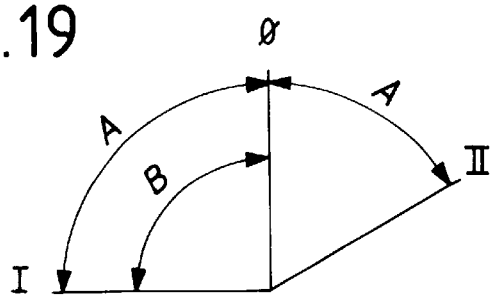
FIG. 19 shows the switching diagram for the rotary switch shown in FIGS. 15–18.

These are arranged and dimensioned in such a way that the two rotary knobs 706 and 706*b* with their ribs 709 and 709*b* of ¶/2 and 5¶/6 length, respectively, permit the switching operations according to FIG. 19 when pushed on, A indicating the switching options of the rotary knob 706 and B indicating the switching operation of the rotary knob 706*b*. From FIG. 19, it is evident that the pulse switching position II is possible only with the rotary knob 706 and that the rotary knob 606*b* permits only the rotary switching operation I-Ø.

The rotary knob 706*b* which fits the switch 701 additionally has a securing rib 710*b* opposite the stop rib 709*b*. Said securing rib serves here for preventing the use of the rotary knob 706*b* on a switch element of the type shown, for example, in FIGS. 10 and 11. Thus, in the embodiment shown, the rib 710*b* is arranged in such a way that, when an attempt is made to mount the rotary knob 706*b* on the housing 603 of the switch 601, the ribs 608 and 710*b* make contact with one another and thus prevent insertion of the key into the switching means 604. In an analogous manner, the use of the rotary knob 606*b* with the switch 701 is not possible. In contrast, however, the rotary knob 706 also fits the switch 601, and the key 706 fits the switch 601. The rotary knobs according to the invention can thus alternatively be formed in such a way that they not only permit specific switching operations but also fit only one switch or can be combined with a plurality of switches.

At this point, it should also be mentioned that the rotary switches described above by no means represent the only possible embodiments of the invention but can also be modified in various respects. Thus, it is readily possible, for example, to dimension the sizes of the ribs very differently from those described above and to equip the rotary switch with more than just two rotary knobs for selective switch actuation.

Furthermore, the front plate can be designed differently from what is shown in the example in the drawing. Thus, it need not of course necessarily be a part of the casing or of the housing of the article to which the switch is to be attached but, as in the case of customary control panels, may be, for example, an intermediate piece which can be screwed on. It may be manufactured, for example, in such a way that the rotary switch is recessed and the surface is, for example, flush with the surface of the front plate, in which case the key of the rotary knob has a correspondingly longer form and projects therefrom.

Furthermore, the antirotation device of the discs 10, 110, 210, 310, 410 and 510 can also be formed by means which differ from the type described above and shown in FIGS. 4 to 9 and may be formed, for example, by catch means which in turn consist of one recess each present in the disc and a rib fitting said recess and arranged on the front plate or on the switch housing. However, the discs can also have, as an antirotation device, position pins or the like which, in the inserted state, engage a recess in the front plate and thus prevent undesired rotation of the disc.

What is claimed is:

1. A rotary switch for switching electrical signals on and off that is configured to be fastened on a front plate, comprising:

rotatable switching means arranged in a cylindrical or conical housing and at least two rotary knobs that are coordinated with the rotary switch, each rotary knob of the at least two rotary knobs having a coupling element insertable into the switching means after the rotary switch is fastened to the front plate;

wherein the rotary switch is secured to prevent overturning of the coupling element by a stop rib that is arranged on each rotary knob and another rib on the outside of the front plate or on the housing that can come into contact with one another, and the at least two rotary knobs have stop ribs having different lengths that are formed and dimensioned to define rotary knobs having different switching authorizations.

2. The rotary switch according to claim 1, wherein the coupling element is a key.

3. The rotary switch according to claim 1, wherein the another rib arranged on the outside of the front plate is formed by a securing disc that is configured to be fastened on the front plate.

4. The rotary switch according to claim 1, wherein the stop rib on each rotary knob is substantially arc-shaped, and each rotary knob has a substantially cylindrical or conical wall section having a free end upon which the stop rib of the rotary knob is arranged.

5. The rotary switch according to claim 1, wherein the stop rib on each rotary knob is substantially arc-shaped, and each rotary knob has a substantially cylindrical or conical wall section having an inside upon which the stop rib of the rotary knob is arranged.

6. A rotary switch arrangement comprising:

a rotatable element that is configured to effect a change of state of a switching element based on an angular position of the rotatable element, and a detachable knob that is configured to be operably coupled to the rotatable element to facilitate rotation of the rotatable element after the rotatable element is installed and detachable from the rotatable element after the rotatable element is installed;

wherein the detachable knob includes one or more ribs that are configured to limit the rotation of the rotatable element.

7. The rotary switch of claim 6, wherein the detachable knob is operably coupled to the rotatable element via a key that is inserted into the rotatable element.

8. The rotary switch of claim 6, further including a variety of different detachable knobs, each coordinated with the rotatable element, wherein each detachable knob of the variety of detachable knobs provides a different limit to the rotation of the rotatable element, thereby effecting different limits to the change of state of the switching element based on the detachable knob that is coupled to the rotatable element.

9. A securing apparatus for a rotary switch, comprising:

a knob that is configured to be coupled to the rotary switch after the rotary switch is installed in its operating position to facilitate rotation of an operable component of the rotary switch, and a securing disc, independent of the rotary switch, that includes an annular ring having a stop rib that is configured to limit rotation of the knob, and thereby limit rotation of the operable component of the rotary switch.

10. The securing apparatus of claim 9, wherein the knob includes a rib that, in conjunction with the stop rib of the securing disc, defines a range of rotation of the operable component of the rotary switch.

11. The securing apparatus of claim 10, wherein the securing disc is configured to accept a variety of different knobs, each knob of the variety of different knobs providing a different rib configuration to provide a different limit to the rotation of the rotary switch.

12. The securing apparatus of claim 10, wherein the knob includes a key that is configured to couple the knob to the rotary switch by inserting the key into the rotary switch.

* * * * *